US006077120A

United States Patent [19]

Futatsugi et al.

[11] Patent Number: 6,077,120

[45] Date of Patent: Jun. 20, 2000

[54] SHIELDED CONNECTOR OF INTERFITTING C-SHAPED SHIELD MEMBERS ON A HOUSING AND METHOD FOR MANUFACTURING THE SAME

[75] Inventors: Takashi Futatsugi, Tokyo; Kikuo Gotoh, Kanagawa, both of Japan

[73] Assignee: The Whitaker Corporation, Wilmington, Del.

[21] Appl. No.: 09/202,114

[22] PCT Filed: Sep. 4, 1997

[86] PCT No.: PCT/US97/15513

§ 371 Date: Mar. 4, 1999

§ 102(e) Date: Mar. 4, 1999

[87] PCT Pub. No.: WO98/10492

PCT Pub. Date: Mar. 12, 1998

[30] Foreign Application Priority Data

Sep. 6, 1996 [JP] Japan ..... 8-257638

[51] Int. Cl.[7] ..... H01R 13/648

[52] U.S. Cl. ..... 439/607; 439/676

[58] Field of Search ..... 439/607, 676, 439/609, 610

[56] References Cited

U.S. PATENT DOCUMENTS

| | | | |
|---|---|---|---|
| 5,037,330 | 8/1991 | Fulponi et al. | 439/607 |
| 5,281,169 | 1/1994 | Kiat et al. | 439/607 |
| 5,288,248 | 2/1994 | Chen | 439/609 |
| 5,496,195 | 3/1996 | Reed | 439/607 |
| 5,637,015 | 6/1997 | Tan et al. | 439/607 |
| 5,685,739 | 11/1997 | Davis et al. | 439/607 |
| 5,709,569 | 1/1998 | Buck et al. | 439/607 |
| 5,913,698 | 6/1999 | Keng | 439/609 |

*Primary Examiner*—Lincoln Donovan
*Assistant Examiner*—Hae Moon Hyeon

[57] ABSTRACT

A shielded connector (10,110) having a pair of substantially C-shaped shield members (40,70;140,170) mounted on the outside surfaces of a substantially box-shaped insulating housing (20,120). Shield members (40,140;70,170) are disposed so that each shield member is superimposed on three of the six outside surfaces of the insulating housing (20, 120). A shroud (49) that includes a mating opening (48) used for engagement with the mating connector is formed in the forward shield member (40,140). A contact extension opening (74) is formed on the rearward shield member (70), and the contacts (30) include tines (32) extending rearward through contact extension opening (74). After the shield member (70) has been mounted, the tines (32) are bent to form throughhole-mountable or surface mountable type tines.

8 Claims, 5 Drawing Sheets

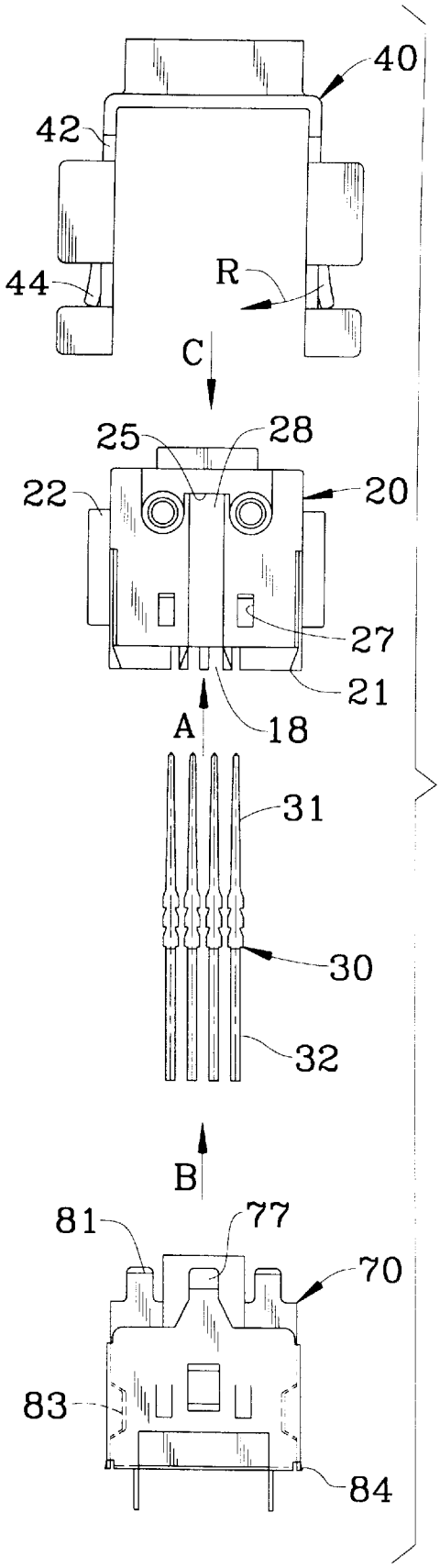
FIG. 9
FIG. 10
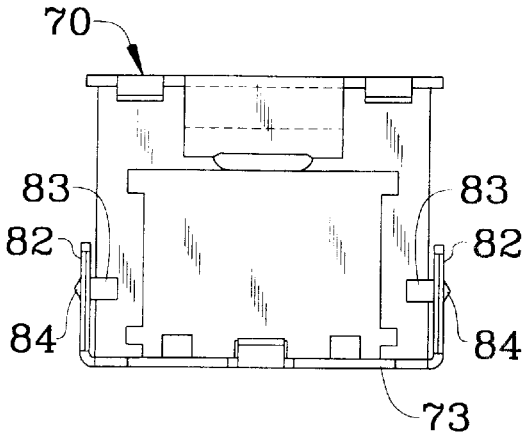
FIG. 11
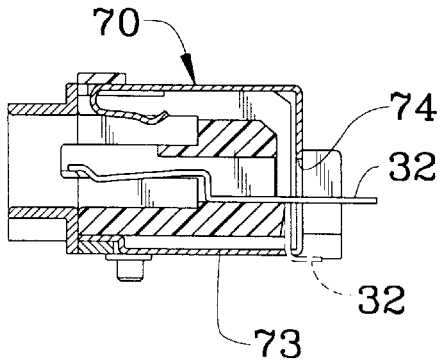

SHIELDED CONNECTOR OF INTERFITTING C-SHAPED SHIELD MEMBERS ON A HOUSING AND METHOD FOR MANUFACTURING THE SAME

FIELD OF THE INVENTION

The present invention relates to the field of electrical connectors and more particularly to shielded connectors.

BACKGROUND OF THE INVENTION

The installation of metal shield members on the outside surfaces of substantially box-shaped insulating housings of electrical connectors for the purpose of preventing electrical noise has been known in the past.

One example of a shielded electrical connector of this type is disclosed in Japanese Utility Model Application No. 5-34679. This disclosed electrical connector is a circuit board mounted connector; in this connector, a shield member constructed from metal plates is disposed so that this shield member is superimposed on four of the outside surfaces of the substantially box-shaped insulating housing.

In recent years, electrical connectors have tended to become more compact, and compactness has also been required in the shielded connectors described above. In addition, it is desirable that the shield members be disposed so that the outside surfaces of the connector are enveloped to the maximum extent possible. The object of the present invention is to provide a shielded connector that can easily be manufactured and assembled as a compact connector that has good shielding characteristics, and a method for manufacturing such a shielded connector.

In U.S. Pat. No. 5,281,169 is disclosed a boardmountable connector with right angle contacts and having a shield that comprises a forward shell part disposed across the housing mating face and the opposed side walls, and a rearward shell part that is disposed along the top housing wall and defines a continuous imperforate rear shield wall.

SUMMARY OF THE INVENTION

The present invention is characterized by the fact that in a shielded connector in which a substantially boxshaped insulating housing in which a mating face and a contact extension surface are positioned back-to-back is enveloped by a shielding means, the shielding means consists of a pair of substantially C-shaped shield members, each of which is positioned so that the shield member is superimposed on three of the six outside surfaces of the insulating housing, an opening used for mating with the mating connector is formed in a forward shield member, and a contact extension opening is formed on the rear shield member.

Preferably, the forward one of the substantially C-shape shield members includes a base wall and a pair of opposite walls, with the mating opening being formed in the base wall, and means used for engagement with the insulating housing being formed in the pair of opposite walls. Furthermore, the rear shield member includes a base wall and a pair of opposite walls, with the contact extension opening being formed in the base wall, and means used for engagement with the insulating housing being formed in the pair of opposite walls.

Preferably, furthermore, both of the shield members are formed by working metal plates. In this case, the forward shield member is formed by working a metal plate that is thicker than the metal plate used for the rear shield member, and the mating opening is formed inside a shroud that is formed by reduction working. Furthermore, the rear shield member has contact parts that can contact the forward shielding member.

Furthermore, the present invention is also characterized by the fact that in a method for manufacturing a shielded connector that has a substantially box-shaped insulating housing, the method includes a process in which contacts are fastened inside the insulating housing so that the contacts extend from the rear surface of the housing, a process in which a pair of substantially C-shaped shield members that respectively have an opening used for connector mating and a contact extension opening are mounted on the insulating housing from the mating face and the rear face of the insulating housing so that each of the shield members is superimposed on three different surfaces of the insulating housing, and a process in which the contacts extending from the contact extension opening are subjected to bending.

Preferably, in the mounting process of the pair of shield members, the process in which the forward shield member is mounted from the mating face is performed after the process in which the contacts are subjected to bending.

Preferably, furthermore, the fastening of the contacts inside the insulating housing is accomplished by press-fitting or insert-molding the contacts inside the insulating housing.

The method used to manufacture the shielded connector described above preferably includes a process in which metal plates are worked. In this working process, the pair of shield members described above are formed by the working of metal plates. Of the two shield members, the forward shield member is formed by working a metal plate whose thickness is greater than the thickness of the metal plate used to form the rear shield member. In the forward shield member, a shroud that has the previously described mating opening on the inside is formed by reduction working.

Shielded connectors constituting preferred working configurations of the present invention, and a method for manufacturing these shielded connectors, will now be described by way of example with reference to the attached drawings.

BRIEF DESCRIPTION OF THE DRAWINGS

FIGS. 7 to 9 are exploded plan, side and bottom views of the connector of FIGS. 1 to 6.

FIG. 10 is a front view that illustrates the construction of the rear shield member.

FIG. 11 is a sectional view that shows the state of the contacts prior to bending.

DETAILED DESCRIPTION

Figure 1:
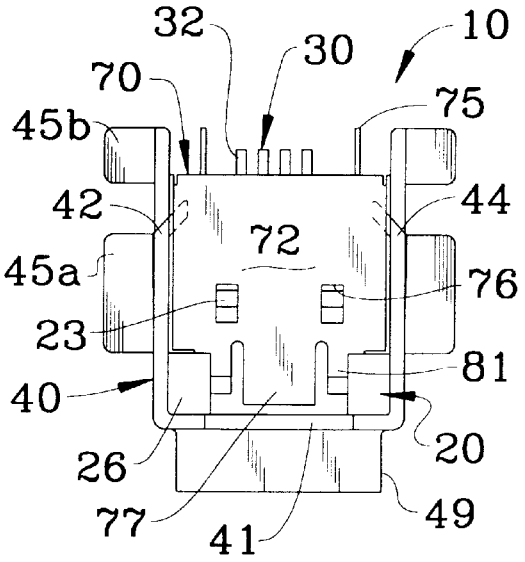
FIGS. 1 to 5 are plan, front, bottom, right side and left side views respectively of a first embodiment of shielded connector of the present invention.
Figure 2:
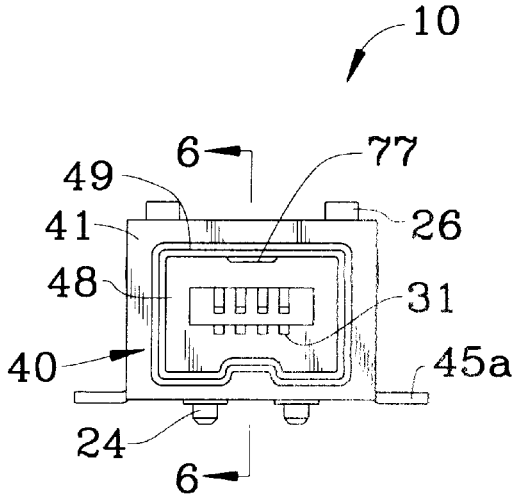
Figure 12:
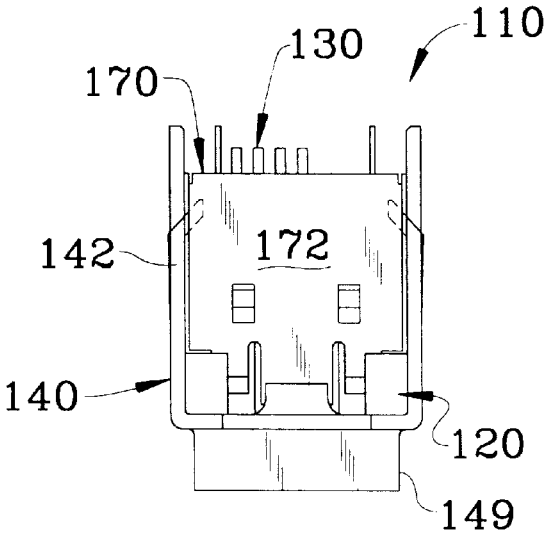
FIGS. 12 to 17 illustrate a second embodiment of shielded connector with FIG. 17 being a sectional view along line 17—17 of FIG. 13.
Figure 13:
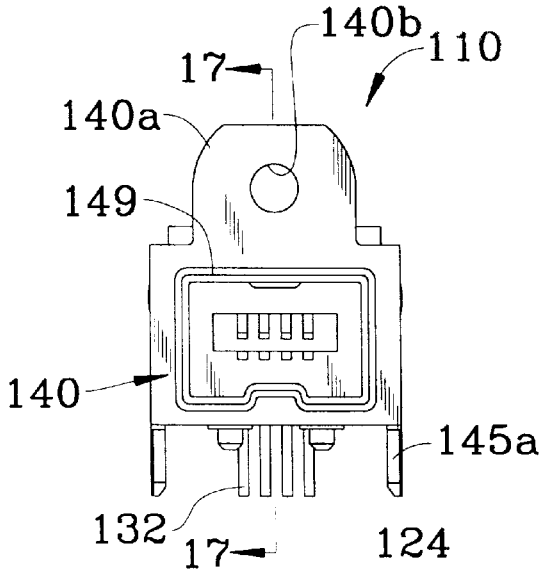
Figure 6:
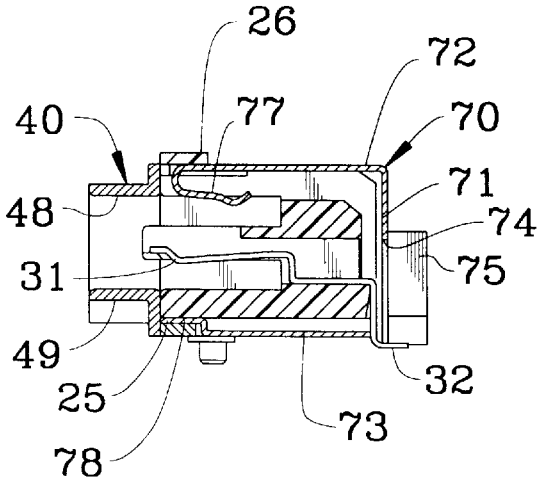
FIG. 6 is a sectional view along line 6—6 of FIG. 2.

FIG. 1 illustrates a shielded connector that constitutes a first preferred working configuration of the present invention. In FIG. 1, the shielded connector 10 is a so-called "SMT type" electrical connector that is surface-mounted on a circuit board; electrical connector 10 has an insulating housing 20, contacts 30 that are fastened to the insulating housing 20, and a pair of shield members 40 and 70 that envelop the insulating housing 20. As is shown in FIG. 6, each of the contacts 30 has a contact arm 31 and an SMT type tine 32 that extends from the rear face 21 of insulating housing 20. The tip end of contact arm 31 is supported in the insulating housing 20. Furthermore, as is shown in FIGS. 2 to 5, a pair of posts 24 on the bottom surface of the insulating housing 20 position the connector on a circuit board.

Forward shield member 40 is substantially C-shaped, and has a base wall 41 positioned along the mating face of insulating housing 20, and opposite side walls 42 and 42 that are adjacent the housing. As is seen primarily from FIG. 6, forward shield member 40 is formed by working a relatively thick metal plate. A shroud 49, inside which is formed an opening 48 that accommodates a portion of the mating connector, is formed in base wall 41 by reduction working. Each of the side walls 42 has an engaging hole 43 that engages with an engaging projection 22 formed on the insulating housing 20, a tongue part 44 that is positioned to the rear of the engaging hole 43, and first and second SMT type solder tabs 45*a* and 45*b* that are formed to protrude outward to the side. Second solder tab 45*b* has a smaller area than the first solder tab 45*a*, and is positioned to the rear thereof. The rear ends of the respective second solder tabs 45*b* substantially coincide with the rear ends of projecting walls 75 (described later) and the contacts 30.

Figure 3:
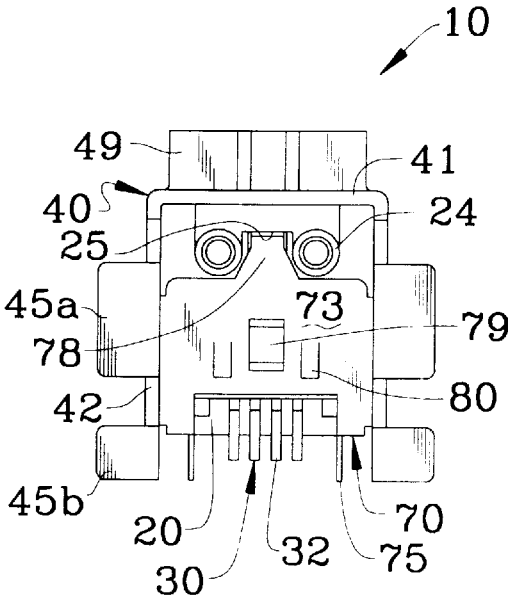
Figure 4:
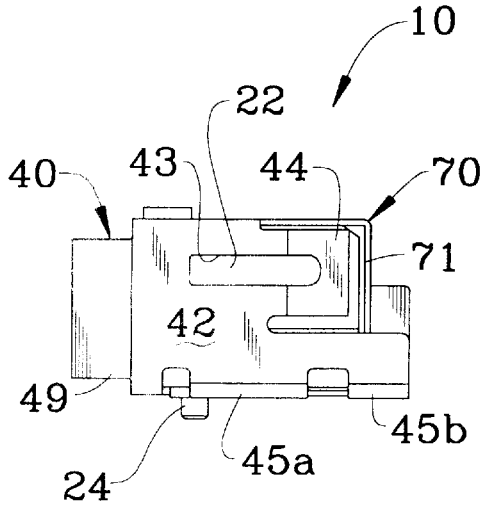
Figure 5:
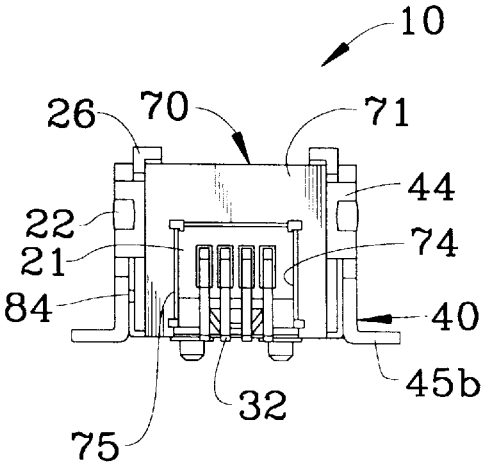
Figure 8:
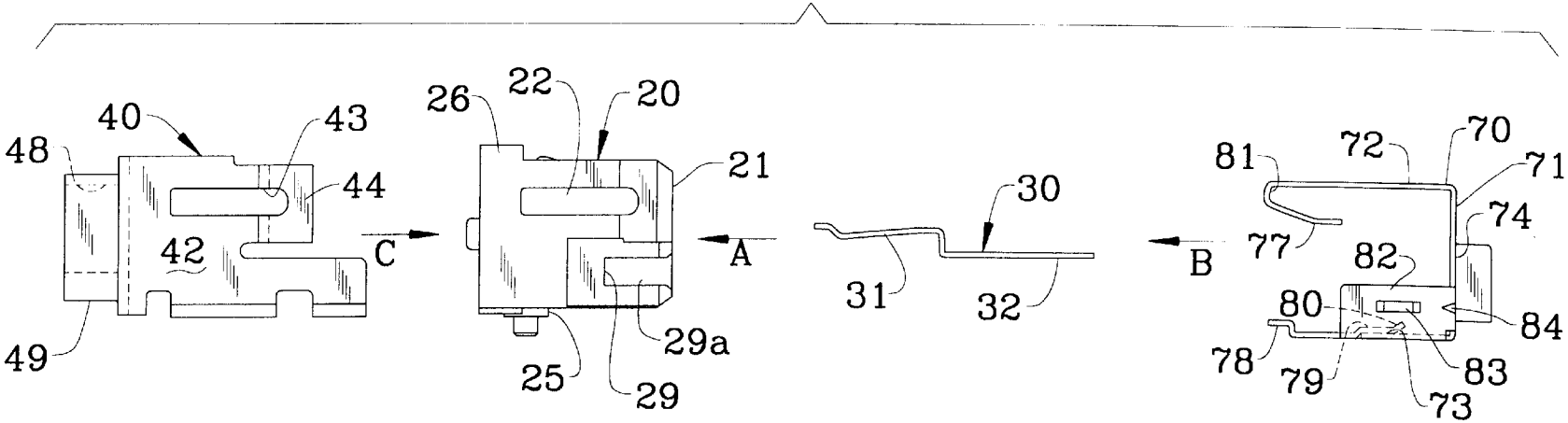
Figure 14:
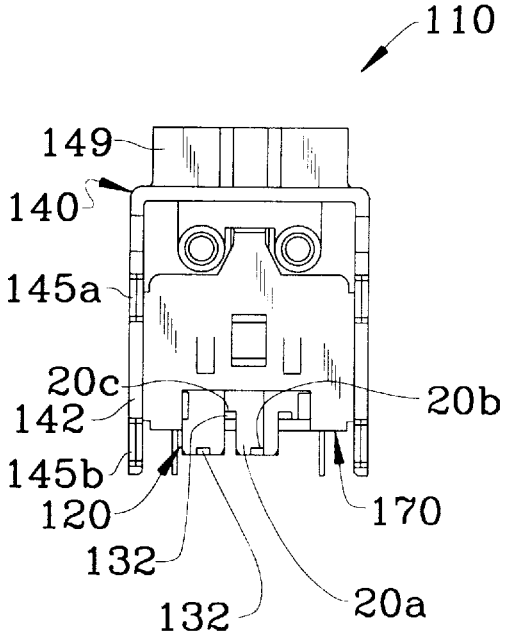

Rear shield member 70 is substantially C-shaped, and has a base wall 71 that is positioned on the rear end of insulating housing 20, and opposite top and bottom walls 72 and 73 positioned on the top and bottom housing surfaces. As is seen primarily from FIG. 6, the shield member 70 is formed by working a relatively thin metal plate. The base wall 71 has an opening 74 in the position where the contacts 30 extend from the insulating housing 20. A pair of projecting walls 75 project to the rear from the side edges of opening 74 that act to protect the tines 32 of the contacts 30. As is shown in FIG. 1, top wall 72 has engaging holes 76 that interlock with engaging projections 23 formed on the insulating housing 20, and a locking part 77 that is formed by being bent in a U-shape at the front end as shown in FIG. 6. Front-end projections 81 positioned on both sides of the locking part 77 engage with support walls 26,26 of the insulating housing 20, and are supported thereby to prevent upward movement. Referring to FIGS. 3 and 8, bottom wall 73 includes a pawl 78 that interlocks with an engaging hole 25 formed between posts 24 of the insulating housing 20, a bridge 79 supported at both ends positioned in the approximate center of the bottom surface 73, and a pair of lances 80 that interlock with the insulating housing 20.

The method used to manufacture the shielded connector 10 will be described with reference to FIGS. 1 to 11.

Figure 7:
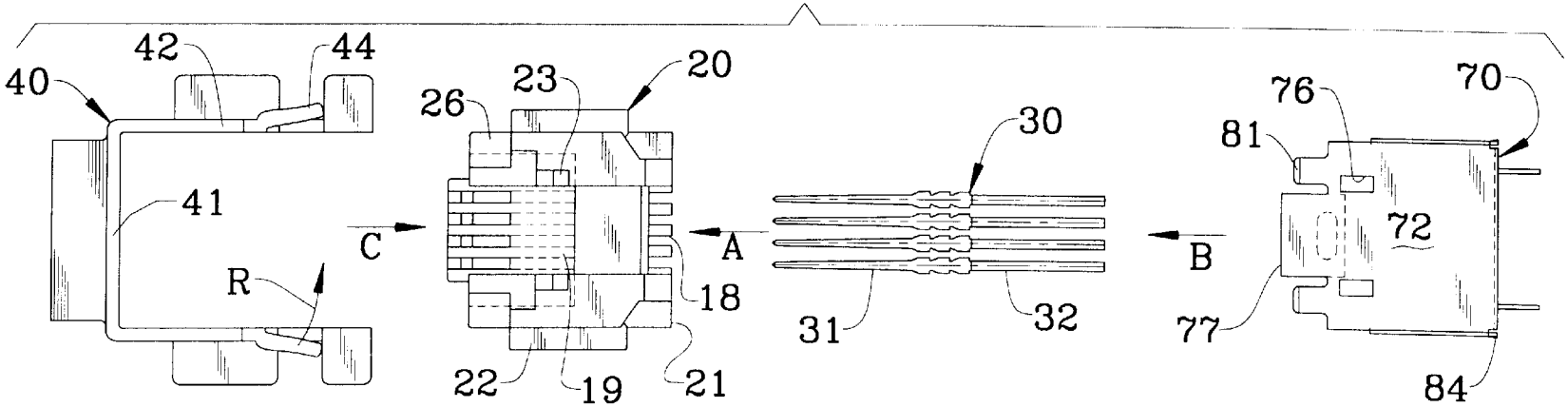

In the first assembly step, the contacts 30 are fastened inside the insulating housing 20 by press-fitting (see arrow A in FIGS. 7 to 9). The contacts are positioned so that the contact arms 31 are disposed in specified positions proximate the mating face, and so that the tines 32 extend initially in a straight line rearwardly from the rear face 21 of the insulating housing 20.

Next, rear shield member 70 is mounted from the rear face of the insulating housing 20 (see arrow B). The locking part 77 is moved through recess 19 in the insulating housing 20 to a specified forward position as shown in FIG. 6. The front-end projections 81 of the top wall 72 become supported by the support walls 26 of the insulating housing 20, and the engaging holes 76 interlock with the engaging projections 23 of the insulating housing 20. Pawl 78 enters hole 25 of housing 20, and lances 80 interlock with recesses 27. As is seen in FIG. 9, a central groove 28 that is aligned with the engaging hole 25 is formed in the bottom surface of the insulating housing 20, and bridge 79 engages therewith; as a result, bridge 79 guides the mounting of the shield member 70, and correctly positions the shield member 70 with respect to insulating housing 20.

As is shown in FIGS. 8 through 10, rear shield member 70 has side wall sections 82 formed by bending both side edges of bottom wall 73 straight upward from positions toward the rear. Each side wall section 82 has a bridge 83 supported at both ends that extends in the direction of mounting of the shield member 70, and a projection 84 positioned on the rear edge of side wall section 82 to the rear of bridge 83.

The respective bridges 83 are accommodated in grooves 29 formed in the side surfaces of the insulating housing 20, and act to guide the side wall sections 82 during mounting, and to correctly position the side wall sections 82.

In the third step, the contacts 30 are subjected to bending. At the time that the shield members 40 and 70 are mounted on the insulating housing 20, the contacts 30 extend rearward substantially in a straight line as shown in FIG. 11. These contacts are then bent at right angles along the rear surface of the insulating housing 20, and are then again bent at right angles along the bottom wall 73 of the shield member 70, thus forming SMT type tines 32 as shown by the dotted line in FIG. 11 (or as shown in FIG. 6). In this position, tines 32 are accommodated in the grooves 18 of the insulating housing 20 shown in FIGS. 5 through 7 and 9.

In the fourth assembly step, forward shield member 40 is mounted from the mating face of the insulating housing 20 (see arrow C in FIGS. 7 to 9). First, the engaging holes 43 formed in the side walls 42 of forward shield member 40, are engaged with the engaging projections 22 on both side surfaces of the insulating housing 20, and extend in the direction of length. Secondly, the tongue parts 44 positioned to the rear of the engaging holes 43 are bent in the direction indicated by arrow R, and are thus caused to undergo plastic deformation so that these tongue parts 44 are oriented as shown in FIG. 1, adjacent to angled rearwardly facing housing surfaces (FIG. 8). As a result, the forward shield member 40 is securely fastened in place with respect to the insulating housing 20.

As is seen from FIG. 10, when the forward shield member 40 is mounted, the projections 84,84 of the rear shield member 70 become engaged with forward shield member 40; realizing a grounding connection between the shield members 40 and 70. Since bridges 83 formed on the rear shield member 70 contact the bottom surfaces 29*a* of grooves 29 of insulating housing 20 (FIG. 8), the side wall sections 82 of rear shield member 70 are subjected to an inward-directed force as a result of the grounding connection of the shield member 40 and become elastically supported by bridges 83.

A shielded connector 110 constitutes a second preferred working configuration of the present invention and will be described with reference to FIGS. 12 to 17. The shielded connector 110 has the same basic structure as the shielded connector 10, with a forward shield member 140, rear shield member 170, and housing 120 with contacts 130. Accordingly, in FIG. 12, members that have the same function as in the shielded connector 10 are indicated by adding 100 to the reference numbers, and details concerning the structure and method of manufacture of such members are omitted. Only the points of difference between the shielded connector 110 and the shielded connector 10 will be described below.

Figure 15:
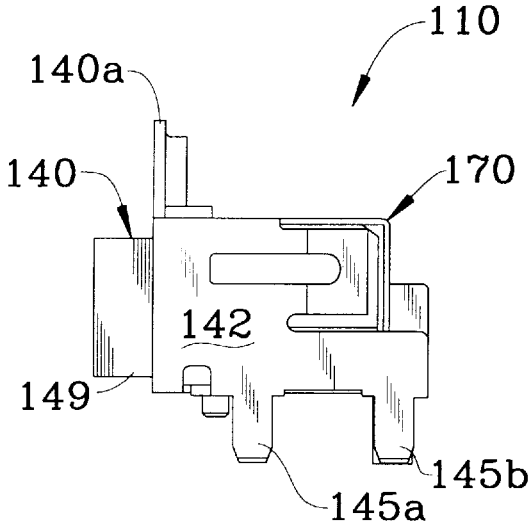
Figure 16:
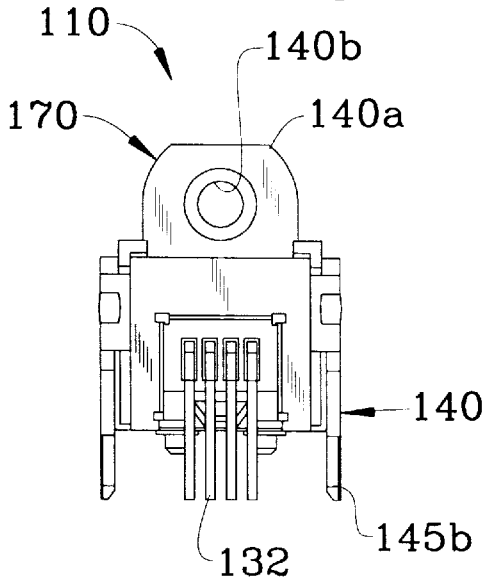
Figure 17:
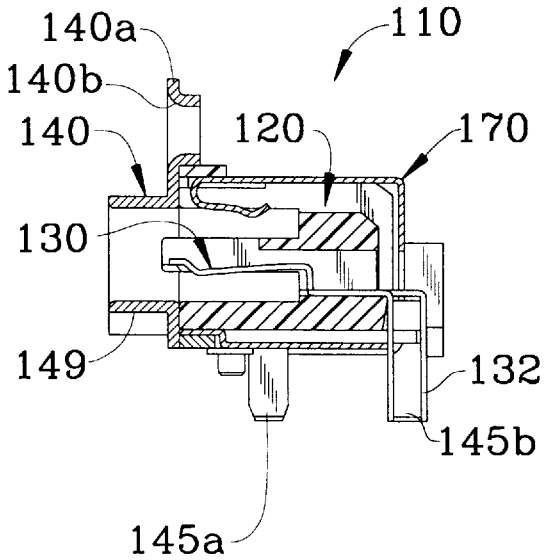

Shielded connector 110 is a so-called DIP type electrical connector mountable onto a circuit board. Accordingly, tines 132 of the contacts 130 are straight tines that are inserted into through-holes in the circuit board (not shown in the figures). Furthermore, first and second legs 145*a* and 145*b* that are accommodated and soldered in slots of the circuit board, depend from respective side walls 142 of the forward shield member 140. As is seen from FIGS. 14 and 17, two of the four straight tines 132 are accommodated in grooves 20*b* formed in the respective tips of projections 20*a* formed on the rear end of the insulating housing 120, while the remaining two tines 132 are accommodated in grooves 20*c* formed at the root positions of projections 20*a*, so that the tines are staggered. The tines 132 are maintained in the correct positions by grooves 20*b* and 20*c*, and the movement of tines 132 is thereby restricted. As is shown in FIGS. 15 and 17, second legs 145*b* are formed in positions located substantially beside tines 132, and thus act to protect them. As in the manufacturing method used to manufacture shielded connector 10, the tines 132 are constructed by bending the contacts 130 at right angles in a bending process constituting the third manufacturing process; thereafter the tines may remain straight for insertion into circuit board through holes as shown in FIG. 17, or be bent again to define surface mountable feet as in FIG. 6.

Furthermore, forward shield member 140 has a panel attachment structure 140*a* that is formed by reduction working to include a screw hole 140*b*, and makes it possible to fasten the shielded connector 110 to a panel using a screw (not shown in the figures). The direction of reduction of the panel attachment structure 140*a* is the opposite direction from the direction of reduction of shroud 149.

Shielded connectors constituting preferred working configurations of the present invention, and methods for manufacturing these shielded connectors, were described above but do not limit the present invention. Various modifications and alterations may be made by a person skilled in the art. For example, especially in regard to the manufacturing method used, the process in which the shield member 40 or 140 is mounted may be performed either before or after the process in which the shield member 70 or 170 is mounted, and may also be performed either before or after the process in which the contacts 30 or 130 are subjected to bending.

A compact shielded connector is provided that has good shielding characteristics. In particular, the shielded connector of the present invention is not a connector in which all of the joints between the pair of shield members are positioned within the planes of the six surfaces of the insulating housing; instead, the metal plates face in substantially perpendicular directions with the joints disposed along the edges. Accordingly, there is no danger that the joints will be opened by stresses applied to the shield members themselves during bending. Furthermore, since the thicknesses of the metal plates forming the shield members can be varied between the mating face side and the rear surface side, this arrangement is ideal for use in cases where it is necessary to form a shroud using a relatively thick metal plate on the mating face side.

We claim:

1. A shielded connector (10,110) having a substantially box-shaped insulating housing (20,120) with a mating face and an opposed contact extension surface (21), the housing being covered by a shielding means (40,70;140,170) consisting of a pair of shield members (40,70;140,170) and an opening (48) used for engagement with the mating connector is formed in a forward one (40,140) of the shield members, characterized in that:

said shield members (40,70;140,170) are substantially C-shaped, each of which is positioned so that said shield member is superimposed on three of the six outside surfaces of said insulating housing (20,120), and a contact extension opening (74) is formed on a rearward one (70,170) of the shield members.

2. The shielded connector (10,110) as set forth in claim 1 further characterized in that said forward shield (40,140) includes outwardly extending solder tabs (45*a*, 45*b*).

3. The shielded connector (10,110) as set forth in claim 1 further characterized in that said forward shield (40,140) is disposed along front and opposed side surfaces of said housing (20,120), and rearward shield (70,170) is disposed along top, bottom and rear surfaces of the housing.

4. The shielded connector (10,110) as set forth in claim 1 further characterized in that said forward shield (40,140) includes side walls inwardly of side wall sections (82) of rearward shield (70,170) and presses inwardly against projections (84) thereof, with bridges (83) of side wall sections (82) disposed in channels (29) of housing (20,120) and pressed against bottom surfaces (29*a*) thereof, establishing a ground connection between the forward and rearward shields (40,70;140,170).

5. The shielded connector (10,110) as set forth in any of claim 1 further characterized in that said forward shield (40,140) includes an outwardly extending panel attachment structure (140*a*) containing a screw hole (140*b*).

6. A method for manufacturing a shielded connector (10,110) having a substantially box-shaped insulating housing (20,120) with shielding means (40,140;70,170) therearound and a plurality of contacts (30,130) therein, said method characterized by including:

a process in which the contacts (30,130) are fastened inside the insulating housing (20,120) so that said contacts extend from the rear face (21) of the housing located on the opposite the mating face thereof, a process in which a pair of substantially C-shaped forward and rearward shield members (40,140;70,140) that respectively have an opening (48) used for connector mating, and a contact extension opening (74), are mounted on said insulating housing from said mating face and said rear face of the insulating housing respectively so that each of said shield members is superimposed on three different surfaces of the insulating housing, and a process in which said contacts (30,130) extending from said contact extension opening are subjected to bending to extend along said rear face (21).

7. The method as set forth in claim 6 further characterized in that said rearward shield (70,170) is mounted to said housing (20,120), said contacts are then bent, and said forward shield (40,140) is thereafter mounted.

8. The method as set forth in claim 6 further characterized in that said forward shield (40,140) includes side walls (42) having tongue parts (44) that are deformed inwardly to extend along rearwardly facing surface portions of said housing (20,120) to assist in securing said forward shield thereonto.

* * * * *